United States Patent [19]

Mutschler

[11] Patent Number: 4,493,575

[45] Date of Patent: Jan. 15, 1985

[54] RELEASABLE PROTECTIVE HOLDER FOR A WRITING IMPLEMENT

[76] Inventor: Otto Mutschler, Ludolf-Krehl-Strasse 12, 6900 Heidelberg, Fed. Rep. of Germany

[21] Appl. No.: 437,104

[22] Filed: Oct. 27, 1982

[30] Foreign Application Priority Data

Dec. 17, 1981 [DE] Fed. Rep. of Germany .....8136741

[51] Int. Cl.[3] ..... B43K 13/00

[52] U.S. Cl. ..... 401/195; 211/69.5; 211/69.8; 401/131; 401/251; 401/258

[58] Field of Search ..... 401/131, 258, 195, 259; 81/125; 211/69.1, 69.5, 69.6, 69.8, 69.9

[56] References Cited

U.S. PATENT DOCUMENTS

| | | | |
|---|---|---|---|
| 1,674,260 | 6/1928 | Palmer | 211/69.6 |
| 1,762,104 | 6/1930 | Liddell | 211/69.5 |
| 1,842,677 | 1/1932 | Kouacs | 211/69.5 |
| 2,752,811 | 7/1956 | Wenchel | 81/125 |
| 2,956,462 | 10/1960 | Paul | 81/125 |
| 3,176,622 | 4/1965 | Williams | 211/69.5 |
| 3,463,323 | 8/1969 | Riepe | 401/131 X |
| 3,830,574 | 8/1974 | Glombitza et al. | 401/258 X |
| 3,866,992 | 2/1975 | Katz | 211/69.5 |

FOREIGN PATENT DOCUMENTS

| | | | |
|---|---|---|---|
| 288679 | 11/1915 | Fed. Rep. of Germany | 211/69.5 |
| 2380895 | 10/1978 | France | 211/69.5 |

*Primary Examiner*—Steven A. Bratlie
*Attorney, Agent, or Firm*—Kurt Kelman

[57] ABSTRACT

A releasable protective holder for a tip of a writing or drafting implement including a polygonal part, a cylindrical part extending therefrom and a writing or drafting tube on the cylindrical part extending into the holder when theimplement tip is held therein, which comprises a first receiving portion of a polygonal cross section keyed to the polygonal part, the first receiving portion including an annular bottom wall engaging an end face of the polygonal implement tip part, and a second, tubular receiving portion extending from the annular bottom wall of the first receiving portion to a free end thereof, the tubular receiving portion yieldingly surrounding the cylindrical part of the implement tip and defining a bore having at the free end of the bore a diameter smaller than the diameter of the cylindrical part for releasably clamping the implement tip in the protective holder.

4 Claims, 8 Drawing Figures a-a b-b a - a b - b

RELEASABLE PROTECTIVE HOLDER FOR A WRITING IMPLEMENT

The present invention relates to improvements in a releasable protective holder or closure for a tip of a writing or drafting implement including a polygonal part, a cylindrical part extending therefrom and a writing or drafting tube on the cylindrical part extending into the holder when the implement tip is held therein.

In my copending U.S. patent application Ser. No. 346,622, filed Feb. 8, 1982, whose entire disclosure is incorporated herein by reference, I have disclosed such a protective holder comprising a first receiving portion of a polygonal cross section keyed to the polygonal part, the first receiving portion including an annular bottom wall engaging an end face of the polygonal implement tip part, and a second, tubular receiving portion extending from the annular bottom wall of the first receiving portion to a free end thereof, the tubular receiving portion yieldingly surrounding and clamping the cylindrical part of the implement tip. When the tubular point of the implement tip is to be cleaned, it is released from the holder and can then be removed.

This arrangement has been used successfully but the manufacture thereof has involved some problems because of the considerable differences in the gage of different wall portions of such an integrally made holder. These differences in the wall thickness along the length of the holder shaft have been found to be particularly disadvantageous where the surfaces thereof are to be dull or striped.

It is the primary object of this invention to imporove on the type of releasable holder hereinabove described by avoding substantial wall thickness differences.

The above and other objects are accomplished according to the invention with a holder whose tubular receiving portion defines a bore having at the free end thereof a diameter smaller than the diameter of the cylindrical part for releasably clamping the implement tip in the protective holder. This smaller diameter is obtained in accordance with the invention with a bore which conically tapers from the annular bottom wall towards the free end, or by providing at least two radially inwardly projecting bosses or cams defining the smaller diameter.

Figure 1:
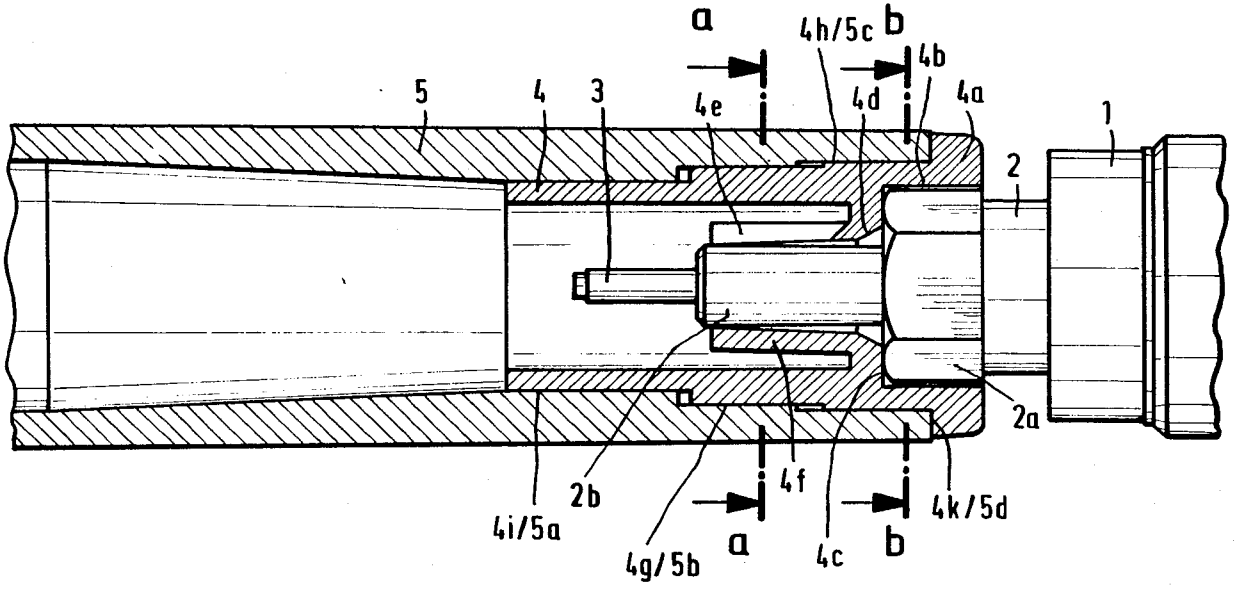
Figure 1A:
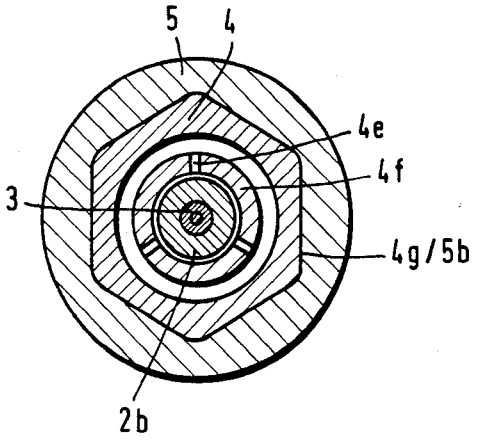
Figure 1B:
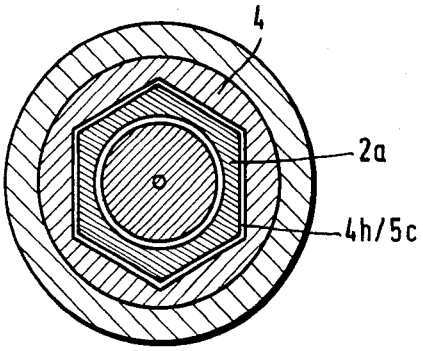

The above objects, advantages and features of the present invention will become more apparent from the following detailed description of certain now preferred embodiments of this invention, taken in conjunction with the accompanying drawing wherein FIG. 1 shows an axial section of the releasable protective holder, with the tip of an India ink writing or drafting implement yieldingly clamped therein;

FIG. 1*a* is a transverse section along line a—a of FIG. 1;

FIG. 1*b* is a transverse section along line b—b of FIG. 1.

Figure 2:
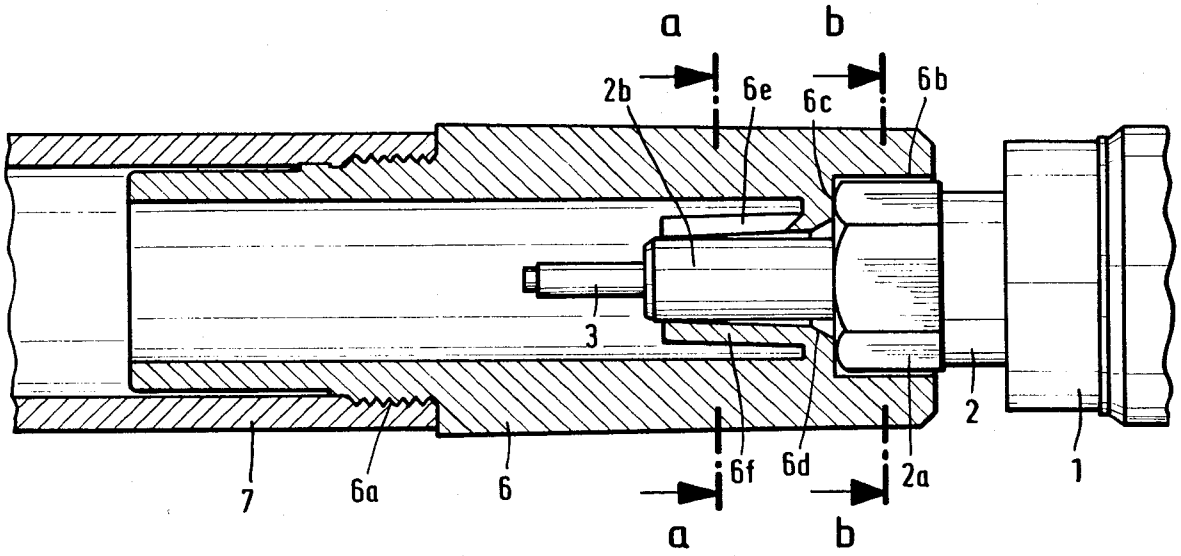
Figure 2A:
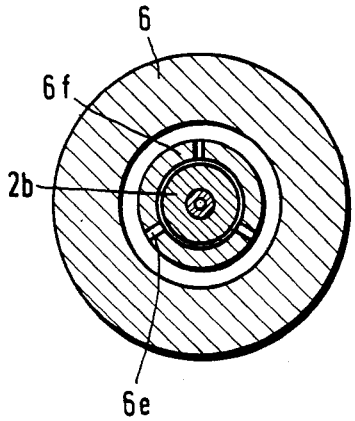
Figure 2B:
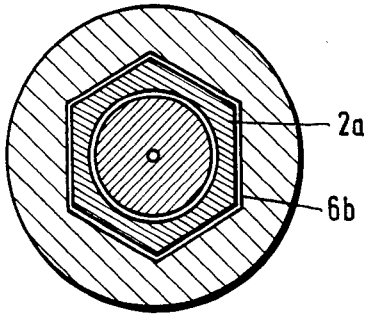
Figure 3A:
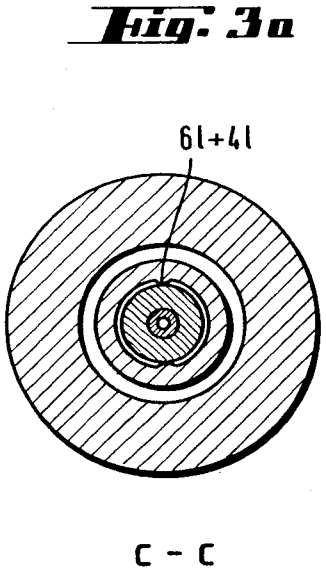
Figure 3:
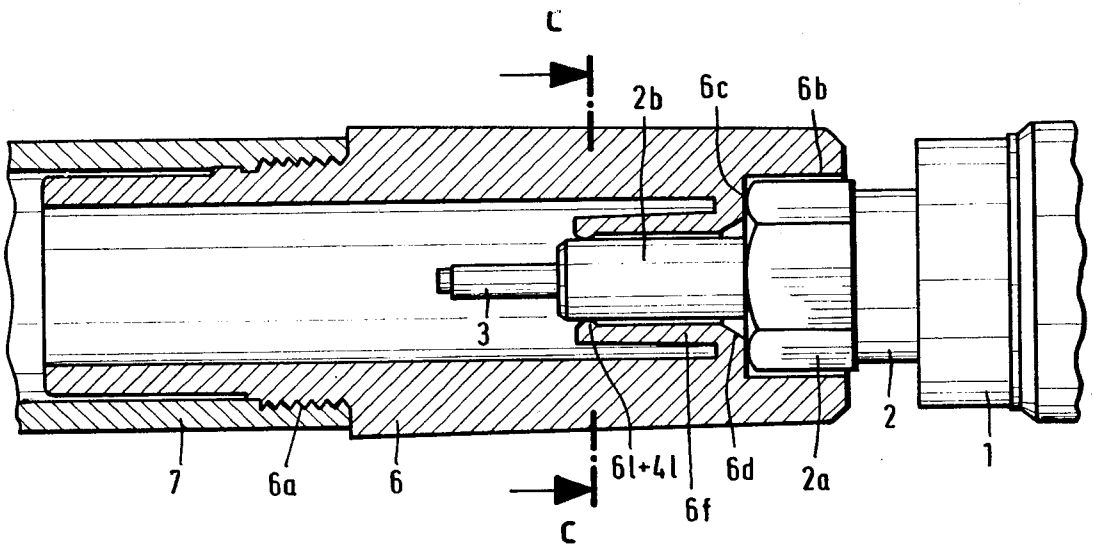

FIGS. 2, 2*a* and 2*b* are analogous views of another embodiment of the holder according to this invention;

FIG. 3 shows an axial section of yet another embodiment of the holder; and

FIG. 3*a* is a transverse section along line c—c of FIG. 3.

Referring now to the drawing, wherein like reference numerals designate like parts functioning in a like manner in all figures, FIGS. 1, 1*a* and 1*b* illustrate a portion of releasable protective holder or closure 4 for tip 2 of writing or drafting implement 1 including polygonal part 2*a*, drafting tube 3 on the cylindrical part extending into the cylindrical part 2*b* extending therefrom and writing or holder when the implement is held therein. Holder shaft 5 is frictionally held on holder 4. Shaft 5 has a large diameter bore 5*c* and its end 5*d* engages shoulder 4*k* of an annular collar 4*a* on holder 4 surrounding polygonal part 2*a*. The collar may serve as a color marker. Holder 4 has cylindrical wall 4*h* received in conforming wall portion 5*c* of holder shaft 5 to center the holder in the shaft, followed by polygonal, i.e. hexagonal, wall 4*g* received in conforming wall portion 5*b* of the holder shaft so as to maintain the holder in the shaft against rotation, and innermost cylindrical wall 4*i* frictionally fitting into conforming wall portion 5*a* of the holder shaft. In this manner, holder 4 and casing shaft 5 form a two-part unit.

Tip 2 of writing or drafting implement 1 is releasably clamped into unit 4, 5 in the following manner:

The holder comprises first receiving portion 4*b* of a polygonal, i.e. hexagonal, cross section keyed to polygonal, i.e. hexagonal, part 2*a* of tip 2 and this receiving portion of the holder has bottom wall 4*c* engaging an end face of polygonal implement tip part 2*a*. Second, tubular receiving portion 4*f* extends from annular bottom wall 4*c* to a free end thereof and receiving portion 4*f* yieldingly surrounds cylindrical part 2*b* of implement tip 2, for which purpose tubular receiving portion 4*f* is slotted, as shown at 4*e*. According to this invention, second receiving portion 4*f* of holder 4 defines a bore having at the free end of the bore a diameter smaller than the diameter of cylindrical implement tip part 2*b* for releasably clamping implement tip 2 in protective holder 4, 5. In the embodiment of FIG. 1, this relationship is attained with a bore which conically tapers from annular bottom wall 4*c* towards the free end. As shown in the drawing, tubular receiving portion 4*f* is connected to annular bottom wall 4*c* by conical connecting part 4*d*.

In the embodiment of FIGS. 2, 2*a* and 2*b*, the releasable clamping arrangement is substantially identical with that hereinabove described, i.e. polygonal part 2*a* of the implement tip is keyed to first receiving portion 6*b* of holder 6 and this receiving portion has annular bottom wall 6*c* engaging an end face of the polygonal implement tip part. Second, tubular receiving portion 6*f*, slotted at 6*e*, extends from the annular bottom wall and yieldingly surrounds cylindrical part 2*b* of the implement tip, the bore of tubular receiving portion 6*f* conically tapering from the annular bottom wall towards the free end thereof and the tubular receiving portion being connected to the annular bottom wall by conical connecting part 6*d*. In this embodiment, however, tubular closure shaft 7 is connected to holder 6 by threaded connection 6*a*.

The embodiment of FIGS. 3 and 3*a* is the same as that of FIG. 2 but has a modified clamping arrangement. In this embodiment, at least two radially inwardly projecting cams 41, 61 on tubular receiving portion 6*f* define the smaller diameter at the free end.

In the illustrated embodiments, the closure shaft and holder are manufactured in two parts and assembled into a unit. The holder part may be color-coded to indicate a certain gage of the writing or drafting point and such a color-coded holder part is shown to extend beyond the end of the closure shaft and to serve as a stopper for this shaft. The illustrated clamping arrangement assures secure seating of implement tip 2 in the holder while the implement tip may be readily released from the holder for cleaning, for example. The holder material, or at least the material of the tubular holder receiving portion, may be elastic to provide for its yielding engagement with cylindrical implement tip part *2b* or, if the material is relatively stiff, the receiving portion is slotted to obtain such yielding clamping engagement.

What I claim is:

1. A releasable protective holder for a tip of a writing or drafting implement including a polygonal part, a cylindrical part extending therefrom and a writing or drafting tube on the cylindrical part extending into the holder when the implement tip is held therein, the holder comprising (a) a first receiving portion of a polygonal cross section keyed to the polygonal part, the first receiving portion including (1) an annular bottom wall engaging an end face of the polygonal implement tip part, and (b) a second, tubular receiving portion extending from the annular bottom wall of the first receiving portion to a free end thereof, the tubular receiving portion yieldingly surrounding the cylindrical part of the implement tip and defining (1) a bore having at the free end of the bore a diameter smaller than the diameter of the cylindrical part for releasably clamping the implement tip in the protective holder.

2. The protective holder of claim 1, wherein the bore of the tubular receiving portion conically tapers from the annular bottom wall towards the free end.

3. The protective holder of claim 1, further comprising at least two radially inwardly projecting cams defining the smaller diameter.

4. The protective holder of claim 1, wherein the tubular receiving portion is slotted.

* * * * *